US007682214B2

(12) United States Patent
Barniak, Jr.

(10) Patent No.: US 7,682,214 B2
(45) Date of Patent: Mar. 23, 2010

(54) RECREATIONAL FLYING DISK APPARATUS FOR ENHANCED FLIGHT ENABLING AND TRAVERSING LAND AND WATER SURFACES

(76) Inventor: Thomas John Barniak, Jr., 6011 Lance Rd., Medina, OH (US) 44256

( * ) Notice: Subject to any disclaimer, the term of this patent is extended or adjusted under 35 U.S.C. 154(b) by 241 days.

(21) Appl. No.: 11/891,007

(22) Filed: Aug. 9, 2007

(65) Prior Publication Data

US 2008/0125001 A1 May 29, 2008

Related U.S. Application Data

(60) Provisional application No. 60/860,784, filed on Nov. 24, 2006.

(51) Int. Cl.
*A63H 27/00* (2006.01)

(52) U.S. Cl. ..... 446/46; 446/48

(58) Field of Classification Search ..... 446/34, 446/46, 47, 48, 236, 238, 241, 153; 473/588, 473/593, 594

See application file for complete search history.

(56) References Cited

U.S. PATENT DOCUMENTS

| | | | | |
|---|---|---|---|---|
| 3,738,053 | A * | 6/1973 | Camarota | 446/47 |
| 4,351,129 | A * | 9/1982 | Kerkenbush et al. | 446/46 |
| 4,940,441 | A * | 7/1990 | Novinsky | 446/46 |
| 5,348,509 | A | 9/1994 | Riccardi et al. | |
| 5,393,256 | A * | 2/1995 | Mitchell et al. | 446/15 |
| 5,540,610 | A | 7/1996 | Sneddon | |
| 5,655,947 | A * | 8/1997 | Chen | 446/46 |
| 5,836,840 | A | 11/1998 | Bustamante et al. | |
| 5,951,353 | A * | 9/1999 | Moore | 446/46 |
| 6,089,998 | A * | 7/2000 | O'Neal et al. | 473/588 |
| 6,231,414 | B1 | 5/2001 | Ho | |
| 6,554,674 | B1 | 4/2003 | Thorne, III | |
| 6,908,359 | B2 | 6/2005 | Orlowski | |
| 7,029,359 | B1 | 4/2006 | Garcia | |
| 7,081,032 | B1 | 7/2006 | Holgate | |
| 7,198,536 | B2 | 4/2007 | Nuccio et al. | |
| 2006/0205544 | A1 * | 9/2006 | Wyner et al. | 473/569 |

* cited by examiner

*Primary Examiner*—Nini Legesse

(57) ABSTRACT

An accessory for affixmentation to a recreational flying disk is disclosed in the form of a separate apparatus that is readily compatible and adaptable to any flying disk that will greatly enhance the flight distance length and the other flight characteristics of that retrofitted disk because of the centrifugal power, ballast stabilization and lift capability that the disclosed invention apparatus transmutes to the said flying disk. The disclosed apparatus, in conjunction with it being the aforementioned aerodynamic catalyst that it becomes once it is affixed to the said thrown flying disk, also can transform the said disk into a flying disk that can skip across the surface of a body of water not unlike a flat stone used for centuries for the same results—that same body of water that would render an ordinary flying disk as immobile upon contact with it now can be considered as just another obstacle to cross just as easily as flying aerially. The many variations of embodiments that are possible and probable are capable of being manufactured in an inexpensive method or manner such as by plastic molding or injection in and as a lightweight composite, which is a proven material both in the durability and safety factorage in the art of recreational flying disks.

5 Claims, 2 Drawing Sheets

RECREATIONAL FLYING DISK APPARATUS FOR ENHANCED FLIGHT ENABLING AND TRAVERSING LAND AND WATER SURFACES

CROSS REFERENCE TO RELATED APPLICATIONS

This application claims the benefits of provisional patent application Ser. No. 60/860,784, filed 2006 Nov. 24 by the present inventor, which is incorporated herein by reference.

BACKGROUND OF THE INVENTION

1. Field of the Invention

The present invention relates to the many varieties of recreational flying disks currently in the marketplace and more precisely, to an apparatus that when attached to any recreational flying disk will exemplify the aerodynamics of that said flying disk resulting in a much longer distance of traveling in flight and the said disk being capable of traversing or 'skipping' on and over the surface of a body of water and if desired, a hard surface such as land, snow, or field of ice.

2. Description of the Related Art

Many variations of the recreational flying disk are currently available to the general consumer and differ in their size and composite material, from the very familiar soft pliable type used for throwing and catching to the smaller, stiffer and heavier types utilized for certain interactive games such as disk or Frisbee golf. Manufacturers have made many attempts to enhance the flight characteristics of flying disks by altering their shape or contour and their weight by providing the disk with a thicker or heavier circumstantial outside rim or just adding weight by manufacturing the flying disk in a heavier composite material. Also, attempts have been made to provide the flying disk with a means to be able to make it capable of traversing or hydroplaning across the surface of a liquid such as water by providing a solid surface on the underside of the disk, which unfortunately alters the aerodynamics of the disk relating to its lift capability, therein reducing the disk to poor flight and hydroplaning characteristics due to the interference with the most important of aeronautic flight principals of any flying structure including a flying disk; its lift capacity.

SUMMARY OF THE INVENTION

The present invention introduces new aerodynamic principals that factor into the flight characteristics of the recreational flying disk in a superior fashion relating to the said disk's lift capability, strength and number of spinning revolutions thereby increasing its flight distance, stabilization in its ability to stay in a horizontal planar position longer in flight thereby also contributing to its flight longevity and converting that same said flying disk into a hydroplaning capability type of disk whereas it will traverse across a surface, liquid or solid, in a tangential 'skipping' fashion—all in a customization method to the thrower of the said flying disk, as every thrower is different in their size, strength, method of throwing and end result desired for that particular throw.

Exactly stating, the present invention is an apparatus consisting of a solid or hollow bladder body of a predetermined composite type, size and shape, disposed at a predetermined point on the underside of a recreational flying disk and attached to a composite threaded fastener which is thereby attached to the airfoil dome of the said disk. The advantages of using the present invention to enhance and convert the flight characteristics of a typical flying disk are as follows: the apparatus disposed on the bottom side of the airfoil dome of the disk, at the axial center of the said disk, acts as ballast to the aircraft in flight. Ballast is as important to flying aircraft as it is to floating ships, that is, it is a stabilizing leveling factor to moving vehicles. The present invention introduces ballast to spinning disks in flight. Just as luggage stored in a commercial jet propelled aircraft is distributed evenly as possible in its underside cargo hold acts as ballast for a smooth and level flight through the air for that aircraft, the ballast weight of the apparatus attached and disposed on the underside of the said disk adds ballast weight at an ideal point on the disk, its axial center spot. At the point of release from the hand of the thrower in a spinning fashion, the present invention apparatus instantly converts into a spinning centrifugal ballast body structure attached to the airfoil dome of the said disk, impelling the spinning rotation of the airfoil dome in a forceful manner to a greater number of spinning revolutions, not only increasing the number of spinning revolutions, but also the strength and velocity of those same spinning revolutions; the number of spinning revolutions increase in number not only because the said disk is spinning faster but also because the present invention apparatus attached to the disk provides more lift capability in the method of its deployment on the underside of the stated disk. Spinning at the same revolution velocity and direction as the dome of the disk it is attached to, the apparatus works in conjunction with the disk's dome, drawing in even more air and wind and helping to circulate that air under the disk's dome underside at the axial center point, thereby allowing for the increased amount of spinning air to give the said dome increased lift, resulting in higher flight altitudes which therein results in the said disk being in an aerial state a longer time allowing for the increase in the number of spinning revolutions; the present invention apparatus's air induction capability also works in conjunction in a physical nature with its ballast weight. When the said disk is thrown the present invention apparatus becomes a spinning ballast weight factor incorporated into the total flight operation of the said disk. The spinning weight when evenly distributed in a constant manner as such when spinning, keeps the lightweight disk's domed flying body in a horizontal planar flying position, even in windy conditions not considered conducive for flying disks, therein allowing for more air induction under the dome which results in more lift, coupled with stronger, faster and greater numbers of spinning revolutions—all of these improvements to the flight characteristics of the typical recreational flying disk that contains the present invention apparatus attached to its underside domed body, will result in much greater distances of flight for its thrower.

Another novel improvement to the art of recreational flying disk activities that the present invention apparatus introduces forthright is its ability to turn a superior flying disk into a superior flying and hydroplaning disk—both contained on the same disk during the same flight, if desired by its thrower. Since the present invention bladder structure body is attached to the dome of the said disk by a threadable connector of a predetermined length, it will simply be a matter of opening more measurable distance from the top of the bladder body to the underside of the dome of the disk or more exactly stating; unthreading the bladder body in a downward fashion until the bottom side of the bladder body extends past the planar lowest point of the dome of the disk the measurable distance desired by the thrower. At this point, not only will the said disk fly with the aforementioned improvements to its flight characteristics, but the said disk can now 'skip' or 'skim' across and over in a tangential fashion, a surface of a liquid such as water. This feat is accomplished by the fact that the present invention apparatus bladder contains a solid composite type structure bottom side which is the side that actually contacts the surface first since it is disposed at a point lower than the outside rim of the dome. Since the bladder structure body is spinning, its solid bottom side will 'skip' on the surface of the water in a tangential fashion, while at the same time providing lift capacity to the said disk, keeping it aerborn. It will be possible and probable for a thrower to 'skip' a flying disk with the attached present invention apparatus a number of tangential touches to the surface much the same as 'skipping' a flat stone across that same surface. For an example of where this novel conversion would come into play as a formidable option would be in the interactive game known as disk or Frisbee golf. A player could now traverse a water hazard with a disk retrofitted with the present invention apparatus or 'skip' the disk into the goal if it is located on or about the water's edge, whereas a water surface would stop an unfitted disk immediately upon its contact with it. It should be stated that it will be possible and probable to 'skip' a surface with a fitted disk and continue aerial, that is 'bounce' the surface and then continue a flight path through the air.

A second type of embodiment of the present invention apparatus is also provided that introduces a new level of customization to the thrower of a fitted disk. Exactly stating, the bladder structure body disposed on the underside of the said disk is of a hollow body, whereas depending on the shape or configuration of the bladder, can be filled to a level chosen by the potential thrower as sufficient for the type of throw desired whereas ballast weight in the form of water or ball bearings, to name as examples, are introduced and stored in the hollow bladder structure body therein transforming into a centrifugal empowering motor not unlike that of the solid composite bladder but with even more centrifugal force transmuted into the dome of the disk attached to. Since many configurations of hollow bladders will be possible and probable, customization to the disk's thrower will be a viable option for the type and distance of throw to be attempted, whereas the thrower can decide on the type and amount of catalyst fuel to introduce into the bladder, dictating a precise ballast weight desired by the thrower. The hollow bladder structure bodies will also be capable of traversing across water, ice, or solid surfaces such as the solid composite embodiment types, therein the flying disks they are attached to as well.

Still another factor that the present invention apparatus introduces into the art of recreational flying disks is the possibility of making a fitted flying disk fly a planned erratic or unpredictable flight route through the air. Since the present invention apparatus can be of any shape, either a circumstantially round embodiment of either a solid or hollow type, it also can be an irregular configuration such as an oval or egg shape—a propeller or even a boomerang shape to name a few geometric shape examples. The different shapes, the point on the underside of the flying disk attached to, the type and weight of the ballast fuel used—all of these stated factors and many more will dictate how and how far the said fitted disk will fly, once the thrower gets acclimated to all the customization elements now possible that the present invention apparatus provides to the common recreational flying disk.

The final advantage points made apparent by the present invention apparatus is one of economics and safety. The apparatus is designed to be manufactured inexpensively such as by injection molding or some other method of fabrication used for plastic or plastic composite parts assuring that simplicity and affordability will be inherent to the marketplace. Also, since the present invention apparatus is designed to be disposed on a point on the underside of a flying disk, the common soft pliable plastic flying disk is the perfect candidate to be retrofitted with the present invention apparatus. Its soft pliable outside rim of its dome is a proven safe embodiment for the hand catching and snatching from an aerial state by the catcher of the disk, and has been as such since the flying disk was introduced about sixty years ago. The present invention apparatus attached and fitted to a flying disk does not mean any variance whatsoever from a safety perspective to the persons throwing and catching a fitted disk, unlike some of the current heavier disks and disks with more weighted outside dome rims manufactured for greater flight distances but possibly injurious to catch because of where that weight is disposed on that flying disk.

Finally, it should be stated that the present invention apparatus, for all that it encompasses and the improvements and the customization to flight characteristics that it brings to the art of throwing and catching recreational flying disks, is exactly what the interactivity and sport needs to be exalted to the next level of aerodynamic entertainment. A study of the preferred embodiment drawings along with the detailed explanation will allow the reader to fully understand even in greater detail all the advantages of the present invention apparatus.

DRAWINGS

Figure 3:
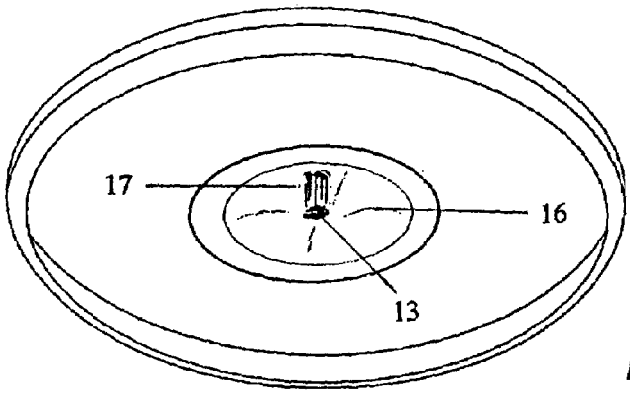
Figure 4:
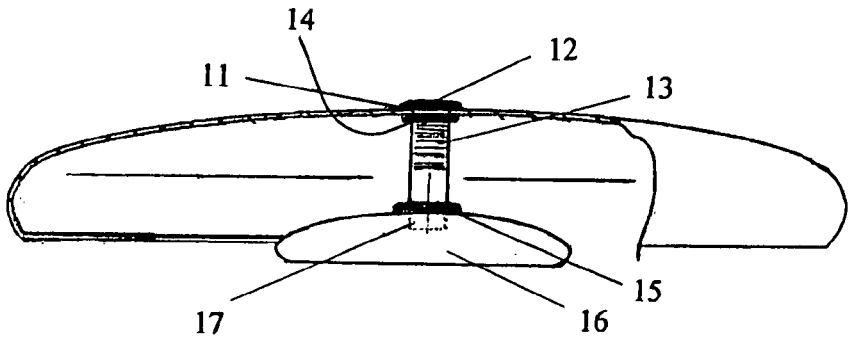

FIG. 3 is a perspective view of the underside of a flying disk with the total invention apparatus affixed in place on the underside of the disk FIG. 4 is a cross-sectional view of a flying disk with the present invention apparatus in a bladder reservoir body embodiment with a flat-shaped bottom end surface affixed to the axial center point of the dome and disposed at a point in the airfoil extending below the circumstantial planar line of the exterior rim of the disk so as to traverse a liquid or solid surface.

Figure 5:
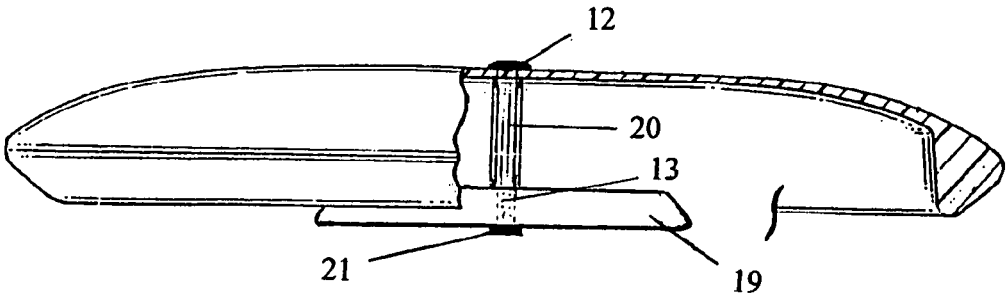

FIG. 5 is a cross-sectional view of a flying disk with the present invention apparatus of a solid composite structure body embodiment disposed at a point in the airfoil extending below the circumstantial planar line of the exterior rim of the disk so as to traverse a liquid or solid surface.

Figure 6:
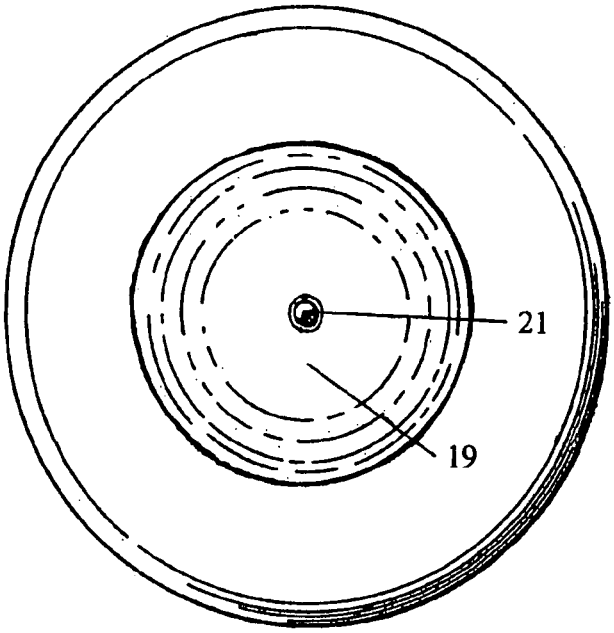

FIG. 6 is a perspective view of the underside of a flying disk with the solid composite structure body embodiment of FIG. 5 affixed and disposed onto it.

REFERENCE NUMERALS

11 hole in dome-drilled
12 fastener head—preferred composite
13 threaded fastener bolt shank—preferred composite
14 threaded nut—preferred composite
15 auxiliary threaded nut—preferred composite
16 reservoir bladder
17 threaded input body section—hidden
18 liquid ballast material—interior, hidden
19 solid composite bladder
20 threaded bushing—preferred composite
21 cap nut—preferred composite

DETAILED DESCRIPTION

Preferred Embodiments

Figure 1:
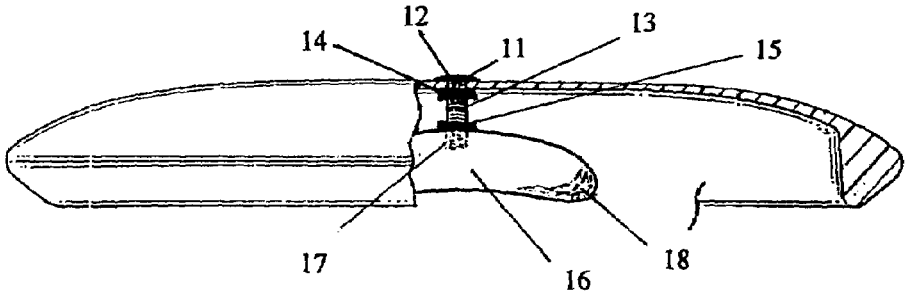
FIG. 1 is a cross-sectional view of a typical flying disk with the present invention apparatus of a bladder reservoir body embodiment with a concave-shaped bottom end surface affixed to the axial center point of the dome and disposed within the airfoil of the flying disk.

FIG. 1 is a cross-sectional view illustrating the position of disposal of the invention apparatus components on the underside of the airfoil dome of a typical composite flying disk being affixed to the said disk at its axial center. A round hole 11 of a sufficient size is drilled through the composite dome of the flying disk at its axial center to receive a threaded fastener bolt shank 13 with a fastener head 12 attached onto one end point of the threaded fastener bolt shank 13. The threaded fastener bolt shank 13 is hand-dropped through the hole 11 from the top exterior of the airfoil dome of the disk until the bottom side surface of the fastener head 12 comes into contact with the exterior surface immediate to the hole 11, wherein a threaded nut 14 is threadably attached and rotated onto the threaded fastener bolt shank 13 until the top surface of the threaded nut 14 comes into contact with the underside surface of the airfoil dome. An auxiliary threaded nut 15 is therein threadably attached to the threaded fastener bolt shank 13 and rotated onto and to a desired stopping point on the bolt shank 13 by the thrower. A predetermined quantity of liquid ballast material 18, such as water as an example of type, is introduced into and poured through the threaded input body section 17 wherein the liquid 18 becomes interiorly stored in the defined interior space capacity of the bladder reservoir 16. Therein the threaded input body section 17 of the bladder reservoir 16 is threaded onto the threaded fastener bolt shank 13 the amount of threaded distance until the top or upper exterior surface of the bladder reservoir 16 comes into contact with the bottom surface of the auxiliary threaded nut 15 and therein hand-tightened. The total invention apparatus is now rigidly affixed to and disposed on the underside of the airfoil dome of the flying disk wherein the invention apparatus becomes a combination centrifugal empowerment with ballast device when thrown in a spinning manner, transmuting the said centrifugal force emanating from the confined spinning liquid 18 in the spinning bladder reservoir 16 into the dome of the disk via the spinning fastener bolt shank 13 attached to the airfoil dome at the fastener head 12. The spinning reservoir bladder 16 containing the centrifugalizing liquid 18 also acts as a stabilizing ballast and enhanced lift enablement structure to the aircraft while also transmuting the said empowerment into the spinning rotations of the aircraft thereby resulting in a much greater distance of measurement to its aerial flight, even for an average thrower and also in atmospheric conditions deemed less than satisfactory for a flying disk that is not retrofitted with the invention apparatus. The preferred material of choice for all components of the invention apparatus is of a plastic composite but should not be construed as being the only option.

Figure 2:
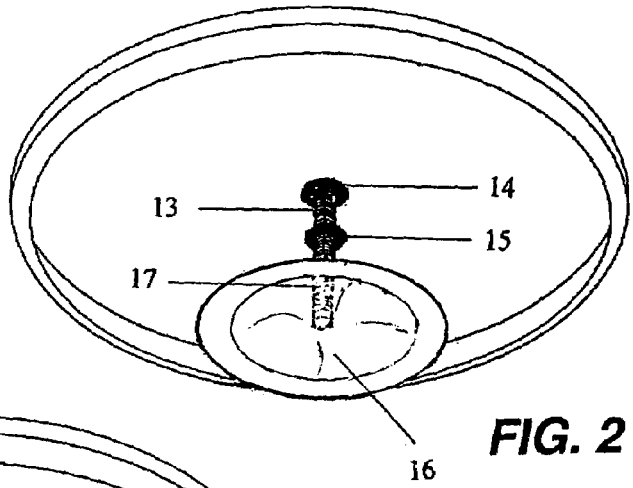
FIG. 2 is a perspective view of the underside of a flying disk with the present invention apparatus transposed on the underside and separated to show components.

FIG. 2 is a perspective view of the present invention apparatus transposed on the underside of a flying disk and showing its components in an illustrated separated state including the interiorly disposed threaded input body section 17 of the reservoir bladder 16, shown in a hidden view.

FIG. 3 is a perspective view of the present invention apparatus showing it in an affixed position to its host flying disk transposed on the underside of the disk and also showing the threaded fastener bolt shank 13 threadably attached into the threaded input body section 17, shown as a hidden view.

FIG. 4 is a cross-sectional view of the present invention apparatus affixed to the axial center point and disposed on the underside and within the airfoil of the dome of the disk. The apparatus components 11,12,13,14,15,16, and 17 are applied exactly as per the explanation disclosed for FIG. 1 except for the difference in the distance the bladder reservoir 16 is threadably attached to the threaded fastener bolt shank 13. In this illustration, the bladder reservoir 16 is threadably attached at a distance on the threaded fastener bolt shank 13 whereas the bottom side surface of the reservoir bladder 16 extends a predetermined measurement of distance below the constant circumstantial planar line of the outermost point of the exterior rim of the disk, thereby providing the flying disk the capacity structure and ability to traverse the surface of a liquid or a solid land surface in an intermittent or 'skipping-like' fashion as the bladder reservoir 16 spins while at the same time providing lift and ballast enhancement to the aircraft. The bladder reservoir 16 is set or 'locked' into this position on the fastener bolt shank 13 with the implementation of hand-tightening of the auxiliary threaded nut 15 to the top surface of the bladder reservoir 16. FIG. 4 shows a reservoir bladder 16 with a flat planar-like structure bottom, which is the spinning contact surface that tangentially strikes or 'touches' the liquid or land surface in an intermittent fashion and is ideally configured for that surface. The concave-shaped bottom surface of the reservoir bladder 16 shown in FIG. 1 is also ideally shaped for traversing a surface but must simply be disposed at a lower point in the airfoil of the disk as aforementioned for that ability to be realized by its thrower. This illustrates the great amount of flexibility and customization the present invention apparatus introduces straightforward for any user and type of throw desired in any situation.

FIG. 5 is a cross-sectional view of the present invention apparatus of a solid composite bladder structure 19 embodiment affixed to the dome of a flying disk at its axial center. The only difference in an affixing methodology between the solid composite bladder 19 and the reservoir bladder 16 embodiments to its host disk is the solid composite bladder 19 contains a hole of a sufficient size completely interposed through its body in a vertical fashion wherein the threaded fastener bolt shank 13 can easily pass completely through the solid composite bladder 19 and therein be locked onto the shank 13 with a threaded cap nut 21 that is finger-applied and tightened to the bottom side of the solid composite bladder 19. FIG. 5 also shows a threaded bushing 20 of a predetermined size threadably attached onto the threaded fastener bolt shank 13, shown as an alternative single embodiment to the threaded nut 14 and auxiliary threaded nut 15 wherein the threaded bushing 20 disposes the bladder 19 at a position point on the shank 13 wherein the disk with apparatus therein has the capability to traverse a solid or liquid surface in an intermittent fashion, as illustrated in FIG. 5. Since the threaded bushing 20 is of a predetermined length of size, a thrower can pre-select the length of the threaded bushing 20 which correlates to the distance point from the underside of the dome desired by that thrower, hand-thread the bushing 20 onto and over the shank 13 until the top of the bushing 20 comes into contact with the underside surface of the dome, slide the solid composite bladder 19 onto the shank 13 until contact with the bushing 20 is made and therein threading the cap nut 21 onto the short length of shank 13 extending through and below the bottom surface of the solid bladder 19 until contact is made with the bottom side surface of the bladder 19, thereby affixing in a rigid fashion the total invention apparatus to the said disk.

FIG. 6 is a perspective view of the solid composite bladder 19 affixed to the underside dome of a flying disk at its axial center showing the cap nut 21 in place on the bladder 19 as viewed from the underside of the disk.

Recreational flying disks and therein the airfoil domes that accompany them vary in shape and configuration; airfoil depth available under the dome, and other dimension related subject matter that dictates that the present invention apparatus to be as varied and interchangeable as well pertaining to sizes, weights, lengths diameters, circumferences and other relating dimensional factors so as to be compatible with any and all flying disks presently in the marketplace so as to enhance and exemplify their flight characteristics and longevity of flight distance. The preferred embodiments disclosed in this specification are precise but many more are possible and probable and when brought forth will not diminish or recede from the entire scope of the invention.

What is claimed is:

1. A recreational flying disk comprising a top surface and a bottom surface; a fastener comprising a head and a threaded shank with a free end; a threaded nut; an auxiliary threaded nut; and a reservoir bladder with a threaded portion; wherein the flying disc can be any new or old flying disk; wherein the disk is provided with a hole at its center; wherein the shank is inserted in the hole with the fastener head resting on the top surface of the disk; wherein both the threaded nut and auxiliary nuts are threaded on the shank; wherein the free end of the shank is threaded into the threaded portion of the bladder; and wherein the threaded nut is positioned against the bottom surface of the disk and the auxiliary nut is threaded to rest against a top surface of the bladder.

2. A recreational flying disk as claimed in claim 1, wherein the reservoir bladder structure is formed of a hollow interior that is capable of storing a liquid or solid material; and wherein the bladder has a hole that is sized to allow the liquid or the solid material to be stored inside the interior of the bladder.

3. A recreational flying disk as claimed in claim 1, wherein the reservoir bladder comprises a single solid structure.

4. A recreational flying disk as claimed in claim 1, wherein a threaded bushing of a predetermined length replaces the threaded nut and the auxiliary threaded nut; and wherein one end of the bushing contacts the bottom surface of the disk and the other end of the bushing contacts the bladder.

5. A method of converting a recreational flying disk into a flying disk that is capable of skipping over the surface of a body of water or land comprising the steps of obtaining a flying disk that has a top surface and a bottom surface, drilling a hole at the center of the disk; providing a fastener comprising a head and a threaded shank with a free end; providing a threaded nut; providing an auxiliary threaded nut; and providing a reservoir or single solid structure bladder with a threaded portion; inserting the shank in the hole with the fastener head resting on the top surface of the disk; threading both the threaded nut and auxiliary nuts on the shank; threading the free end of the shank in the threaded portion of the bladder; positioning the threaded nut against the bottom surface of the disk and positioning the auxiliary nut to rest against a top surface of the bladder.

* * * * *